United States Patent [19]

Willeby et al.

[11] Patent Number: 4,560,128

[45] Date of Patent: Dec. 24, 1985

[54] DRINK HOLDER

[76] Inventors: Randy C. Willeby, Star Rte. and Box 313, Bakersfield, Calif. 93306; Kenneth L. Wheeless, 329 N. Prospect Ave., Porterville, Calif. 93257

[21] Appl. No.: 637,268

[22] Filed: Aug. 3, 1984

[51] Int. Cl.[4] ..... A47C 7/62

[52] U.S. Cl. ..... 248/230; 248/231.5; 248/311.2; 297/188; 24/517; 24/544

[58] Field of Search ..... 248/230, 231.5, 311.2, 248/293, 308, 310, 316.5, 225.31, 316.6, 540, 541, 229, 231.6, 297.2; 24/517, 544, 537, 542, 505, 506, 67.1, 30.5 R; 297/188, 194; 108/28

[56] References Cited

U.S. PATENT DOCUMENTS

| | | | |
|---|---|---|---|
| 593,360 | 11/1897 | Lottermoser | 248/541 |
| 617,096 | 1/1899 | Harrison | 248/541 |
| 1,154,904 | 9/1915 | Bain | 248/316.6 |
| 2,711,872 | 6/1955 | Lampke | 248/229 |
| 3,233,940 | 2/1966 | Tooley | 297/194 |
| 3,881,677 | 5/1975 | Ihlenfeld | 248/311.2 |
| 4,063,701 | 12/1977 | Wray | 248/230 |
| 4,213,649 | 7/1980 | Sell | 248/311.2 |

FOREIGN PATENT DOCUMENTS

| | | | |
|---|---|---|---|
| 604233 | 8/1960 | Canada | 24/67.1 |
| 963441 | 2/1975 | Canada | 248/311.2 |
| 22346 | of 1909 | United Kingdom | 108/28 |

*Primary Examiner*—J. Franklin Foss
*Assistant Examiner*—Robert A. Olson
*Attorney, Agent, or Firm*—Jack C. Munro

[57] ABSTRACT

A drink holder to be mounted on a tubular chair leg or other similar substantially vertically oriented rod-like member. The drink holder includes a drink holder housing which is specially configured to have compartments to connect with separate structures such as a beverage container. A bracket composed of two separate leg members is pivotally connected to the housing. The two separate leg members are hingedly connected together and are also pivotally mounted on the housing between a closed position and an open position.

2 Claims, 4 Drawing Figures

Fig.1.
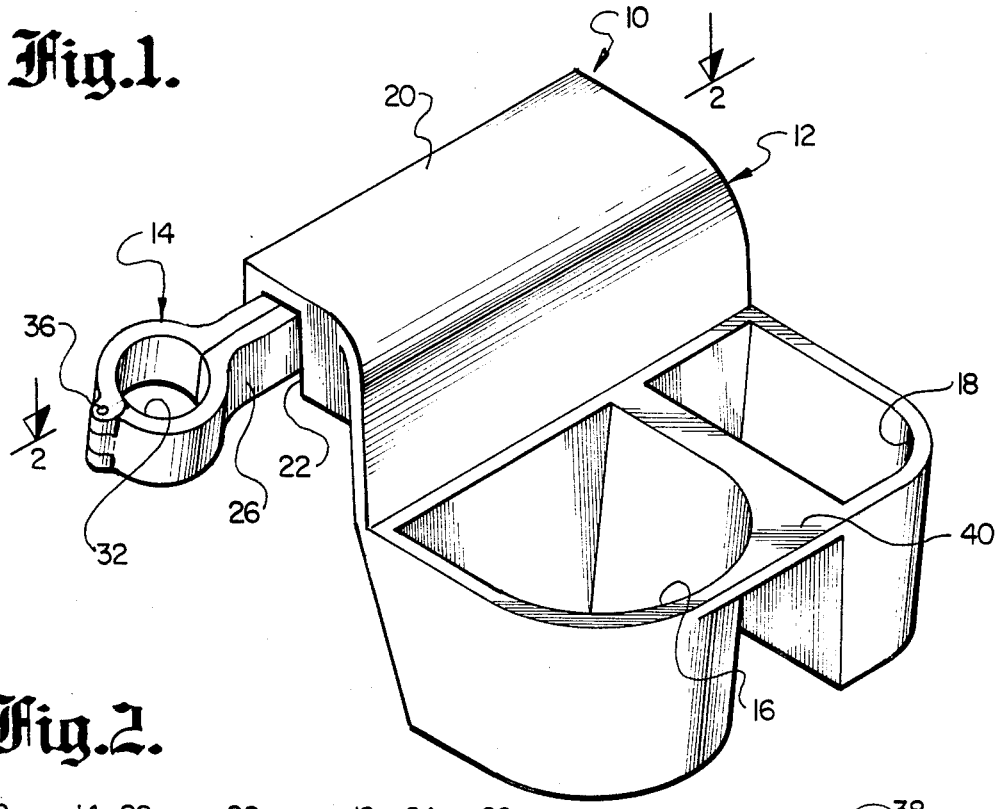
Fig.2.
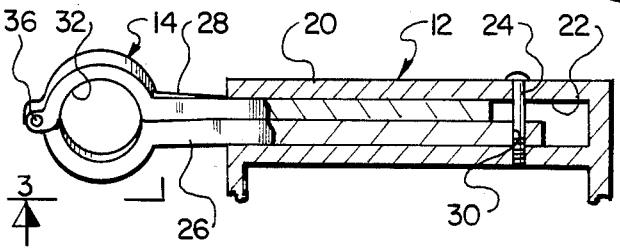
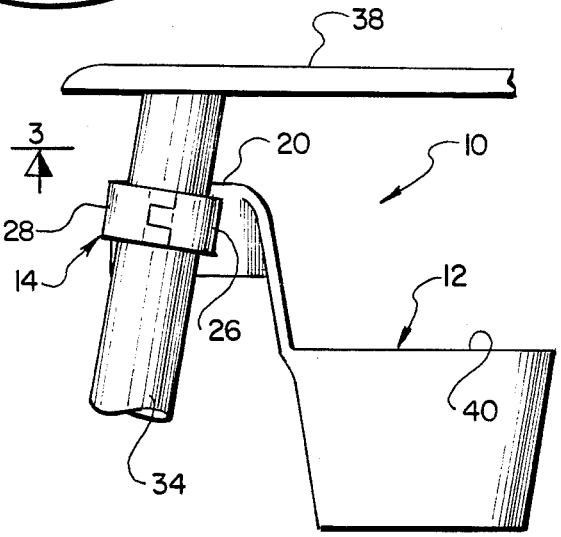
Fig.4.
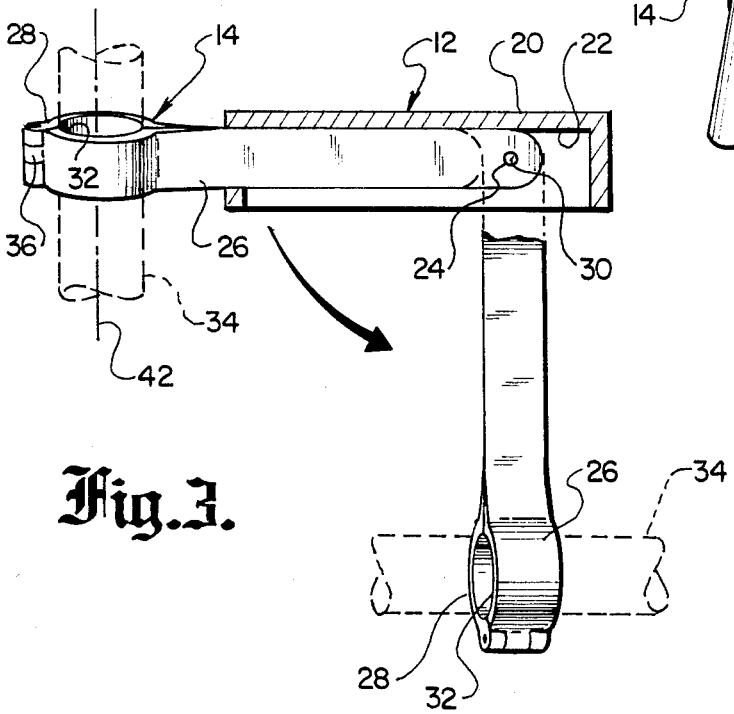
Fig.3.

DRINK HOLDER

BACKGROUND OF THE INVENTION

The field of this invention relates to a drink holder bracket assembly which is to be mounted onto a chair or other similar type of furniture structure.

Most chairs are constructed to not include any provisions for resting a beverage container in conjunction with the chair. Generally, one purpose of a table is to provide for a beverage container resting area. Therefore, there frequently is located a table directly adjacent to the chair.

However, frequently there is not a table which is located nearby a chair. One example would be in a beach chair or chair that may be on a patio or a lawn. In such an instance it would be desirable to design some type of bracket assembly which could be attached to the chair and be used to support a beverage container and other articles, such as a package of cigarettes. Previously, such bracket assemblies have been quite complex in construction and were not easily connectable to the chair. Most such devices required the use of separate tools to attach the device to the chair. Also, such devices were not readily removable from the chair to facilitate the reinstallation of the assembly upon another chair. Because of the complexity of such devices, also such devices were inherently expensive.

SUMMARY OF THE INVENTION

The structure of this invention relates to a drink holder which is to be attachable to a chair or other similar furniture apparatus and can be quickly and easily installed by even the most unskilled individual and does not require the use of any tools for the installation.

Another objective of this invention is to construct a drink holder which is manufactured of few parts and therefore, is manufactured inexpensively.

Another object of this invention is to construct a drink holder which is constructed almost entirely of plastic thereby minimizing effect of weather conditions on the drink holder even if the device is installed on a chair which is located in an outside environment.

The drink holder of the present invention is constructed basically of two separate parts, the first one being the drink holder housing and the second being a bracket. The drink holder housing has article carrying compartments to support structures such as a package of cigarettes and a beverage container. The housing includes an elongated open-sided slot. Located within the slot there is pivotally mounted one leg member of a pair of leg members of a bracket. The remaining leg member is shorter in length than the pivotally mounted leg member. With both leg members in juxtaposition, they can be snugly retained within the elongated slot formed within the housing. The outer end of the bracket includes an opening. A tubular member of a chair is to be snugly located within that opening. The leg members of the bracket can be pivoted approximately ninety degrees which completely frees the shorter leg member from the elongated slot. In this position, the short leg member can be pivoted about a hinge with respect to the longer leg member to free the bracket from the tubular member of the chair.

BRIEF DESCRIPTION OF THE DRAWING

FIG. 1 is an isometric view of the drink holder of the present invention showing the drink holder in its normally insulated position;

FIG. 2 is a cross-sectional view taken along line 2—2 of FIG. 1 showing more clearly the bracket assembly utilized in conjunction with the drink holder of the present invention;

FIG. 3 is a cross-sectional view taken along line 3—3 of FIG. 2 showing the pivoting movement of the bracket assembly with respect to the drink holder housing; and FIG. 4 is an end view of the drink holder of the present invention showing the drink holder installed on a conventional chair leg.

DETAILED DESCRIPTION OF THE SHOWN EMBODIMENT

Referring particularly to the drawing there is shown in FIG. 1 a drink holder 10 of the present invention which is composed generally of a drink holder housing 12 and a bracket 14. The housing 12 includes a forward section which is divided into compartments 16 and 18. Compartment 16 is designed to accommodate a typical beverage container such as a glass or bottle. Compartment 18 is designed to accommodate a form of package goods such as a package of cigarettes.

The housing 12 is formed into a flange section 20 which includes an elongated slot 22. Slot 22 is open at one end thereof and is closed at the opposite end thereof with also the bottom of the slot 22 being entirely open. Mounted within the flange section 20 and extending across slot 22 is a pin 24.

Bracket 14 is formed of two separate leg members 26 and 28. The forward end of the leg member 26 includes a hole 30 through which pin 24 passes. Leg member 28 is of a shorter length than of the leg member 26 and does not come into contact with the pin 24. It is to be noted that the leg members 26 and 28 are capable, when in juxtaposition, of being snugly retained within the slot 22 as is clearly shown in FIGS. 1 and 2 of the drawing.

The outer end of the leg member 26 includes a half circle recess. Also, the outer end of the leg member 28 includes a half circle recess. These half circle recesses cooperate together to form an opening 32. The tubular (generally circular in cross-section) leg member 34 is to be located within the opening 32 and is to be tightly grasped by the wall surfaces of the opening 32. The leg member 28 is hingedly connected by a hinge 36 to the leg member 26.

It is to be noted that most tubular members 34 (a normal chair leg) which are mounted in conjunction with a chair seat 38 are inclined a small angle from vertical (generally about 14 degrees). It is desired that the surface 40 of the housing 12 be located horizontal. Therefore, in order to accomplish this, the longitudinal center axis 42 of the opening 32 is inclined the same angle as the chair leg 34 is inclined from the vertical. Therefore, when the chair leg 34 is located within the opening 32, then the surface 40 is located horizontal so that any beverage container which is located in compartment 16 will not have a tendency to spill.

To install the drink holder 10 of this invention onto the tubular chair leg member 34, the operator first will manually pivot the bracket 14 approximately ninety degrees from its position within the confines of the slot 22 to the position almost totally disengaged from the slot 22. For purposes of description, with the leg members 26 and 28 located within the slot 22, this will be referred to as the "closed position". When the leg members 26 and 28 are pivoted to the ninety degree position, this position will be referred to as the "open position".

In the open position, the short leg member 28 is located completely exteriorly of the slot 22. This permits the leg member 28 to be provided about the hinge 36 to permit entry of the tubular member 34 within the opening 32. When the tubular member 34 is so located within the opening 32 at the desired location, the operator then pivots the leg member 28 about the hinge 36 until leg member 28 again abuts leg member 26. The operator then pivots the housing 12 until the leg members 26 and 28 are again totally located within the confines of slot 22. At this particular time, the drink holder 10 of this invention is securely mounted on the tubular chair member 34 and the drink holder 10 now can be used in the desired manner.

If it is desired to disengage the drink holder 10 from the chair leg 34, it is only necessary that the installing procedure be reversed.

What is claimed is:

1. A drink holder to be mounted on a substantially vertical tubular member, said drink holder comprising:

a housing adapted to support a separate drink container, said housing having an elongated open-sided slot; and a bracket, said bracket being formed of a first leg member and a second leg member, said first member being pivotally attached to said housing, said second leg member being pivotally attached to said first leg member, said second leg member being pivotable between a closed position in juxtaposition with said first leg member to an open position oriented transverse to said first leg member, with said leg members in said closed position forming an opening, said tubular member adapted to be located within said opening, with said first and second leg members in said closed position being locatable within said open-sided slot, said second leg member being movable to said open position only when said leg members are displaced from said open-sided slot.

2. The drink holder as defined in claim 1 wherein:

said first leg member being of a greater length than said second leg member, said first leg member being connected by a pin to said housing.

* * * * *